US006098657A

United States Patent [19]

Sugg

[11] Patent Number: 6,098,657

[45] Date of Patent: Aug. 8, 2000

[54] IN-LINE FLUID FLOW TRAP FOR MODULAR REFRIGERATION SYSTEMS

[75] Inventor: William Sugg, West Salem, Wis.

[73] Assignee: Multistack, Inc., West Salem, Wis.

[21] Appl. No.: 09/094,118

[22] Filed: Jun. 9, 1998

[51] Int. Cl.[7] ..... F16K 31/06

[52] U.S. Cl. ..... 137/546; 137/544

[58] Field of Search ..... 137/546, 544

[56] References Cited

U.S. PATENT DOCUMENTS

| | | | |
|---|---|---|---|
| 38,138 | 4/1863 | Bond | 137/546 |
| 55,822 | 6/1866 | Cornelius | 137/546 |
| 1,085,159 | 1/1914 | Raab | 137/546 |
| 1,684,475 | 9/1928 | Collier et al. | 137/546 |
| 1,860,425 | 5/1932 | McCune et al. | 137/546 |
| 3,722,529 | 3/1973 | Arakawa | 137/546 |
| 4,852,362 | 8/1989 | Conry | 137/546 |
| 4,947,890 | 8/1990 | Sumida et al. | 137/546 |

*Primary Examiner*—A. Michael Chambers
*Attorney, Agent, or Firm*—Dvorak & Orum

[57] ABSTRACT

An-line trap assembly is disclosed for preventing the drop out of suspended particulant matter within a cooling water flow stream. The in-line trap assembly is provided with a collector tank for gathering debris and a bleed through piping network for creating a continuous flow of cooling water. The continuous flow of cooling water from a supply header to a return header assists in moving the debris into the collector tank where the collected sediments are then removed by a manual or automated blow-down of the in-line trap.

9 Claims, 1 Drawing Sheet

IN-LINE FLUID FLOW TRAP FOR MODULAR REFRIGERATION SYSTEMS

BACKGROUND OF THE INVENTION

1. Field of the Invention

This invention relates to modular refrigeration systems and in particular, to an in-line fluid flow trap which removes entrained impurities from the cooling water circulating through the modular refrigeration system.

2. Discussion of the Prior Art

Art conditioning installations for modern buildings, office structures, shopping complexes, warehouses and the like, comprise, air treatment units to which water or other heat exchanges fluids are pumped, whereby air is indirectly cooled by the heat exchange fluid during summer months or is heated during winter months and is then circulated to the areas desired to be conditioned. The heat exchange fluid for cooling is generally circulated through an evaporator/chiller of a refrigerator system which removes heat (for cooling purposes) from the air to be conditioned. Heat within the first heat exchange fluid is transferred into a second heat exchange fluid which circulates through the condenser of the refrigeration system. The second heat exchange fluid usually comprises water or another liquid or even may comprise air in an air cooled or evaporative cooling system.

The trend towards refrigeration systems has been to remove the inefficient large capacity, single unit refrigeration systems, substituting instead modular refrigeration systems where a series of independent miniature refrigeration units can be linked together in a series fashion to provide an expandable refrigeration system which can closely meet the exact needs of the heating or cooling demand, thereby providing operating efficiencies not capable with the single, large capacity unit.

Modular refrigeration systems have found particular merit in various building structures where provision is made for the future expansion of the building structure, whereby a like expansion of the refrigeration system can also be readily accomplished. In this way, a very efficient refrigeration system which is operating at full capacity or near full capacity can be realized. Likewise, modular refrigeration systems have been found to be particularly useful in rehabilitating older building structures which were never equipped with refrigeration equipment. In those applications, modular units are extremely well-adapted for use where space limitations would prevent installation of single, large capacity units.

However, it has been discovered that when the individual modules are serially connected together, the unit which is last in line for the modular system, experiences water purity problems which leads to blockage of the cooling water supply header on that unit. More specifically, since the cooling water flowing to the units has the natural tendency to experience wall friction and pressure losses as it encounters each successive individual module, when the last module is reached, many of the impurities entrained within the cooling water supply will have a tendency to drop out in the header piping of the very last individual module. The impurities can amount to a quite substantial blockage of the header pipe in the last individual module, whereby the cooling water flowrate and supply for the last module is effectively deminimus. As the cooling water supply header pipe for the last unit becomes further and further blocked, it has been found that the penultimate individual module will eventually experience the same gradual blockage which the last module experienced. Over a very long period of time, if the condition is not discovered and allowed to continue, each supply header pipe of each individual module will eventually become blocked such that the very first module will effectively be the only operating module.

It is desirable therefore to find a means for eliminating the blockage of the individual header pipes so that maximum operating efficiencies can be maintained in each individual refrigeration module.

It is another object of the present invention to provide such means whereby the cleansing of the header pipes can be maintained continuously and automatically.

SUMMARY OF THE INVENTION

According to a preferred aspect of the present invention, there is provided an in-line trap arrangement for removing foreign material suspended within the circulating cooling water of the refrigeration system. The in-line trap is designed to advantageously use the flow energy of the supplied cooling water to progressively move any impurities that have settled in the header piping of that individual refrigeration module, or interconnected headers of several modules into a trap collection tank located at the end of the header piping for the last refrigeration unit. The collected sediments are then removed from the collection tank by providing an automated blow-down of the in-line trap.

The automated blow-down can be performed by incorporating a timed solenoid valve or a solenoid valve coupled with a master programmable logic controller for the modular refrigeration system itself. Manual blow-down can be provided to save hardware and installation costs.

DETAILED DESCRIPTION OF THE DRAWINGS

Figure 1:
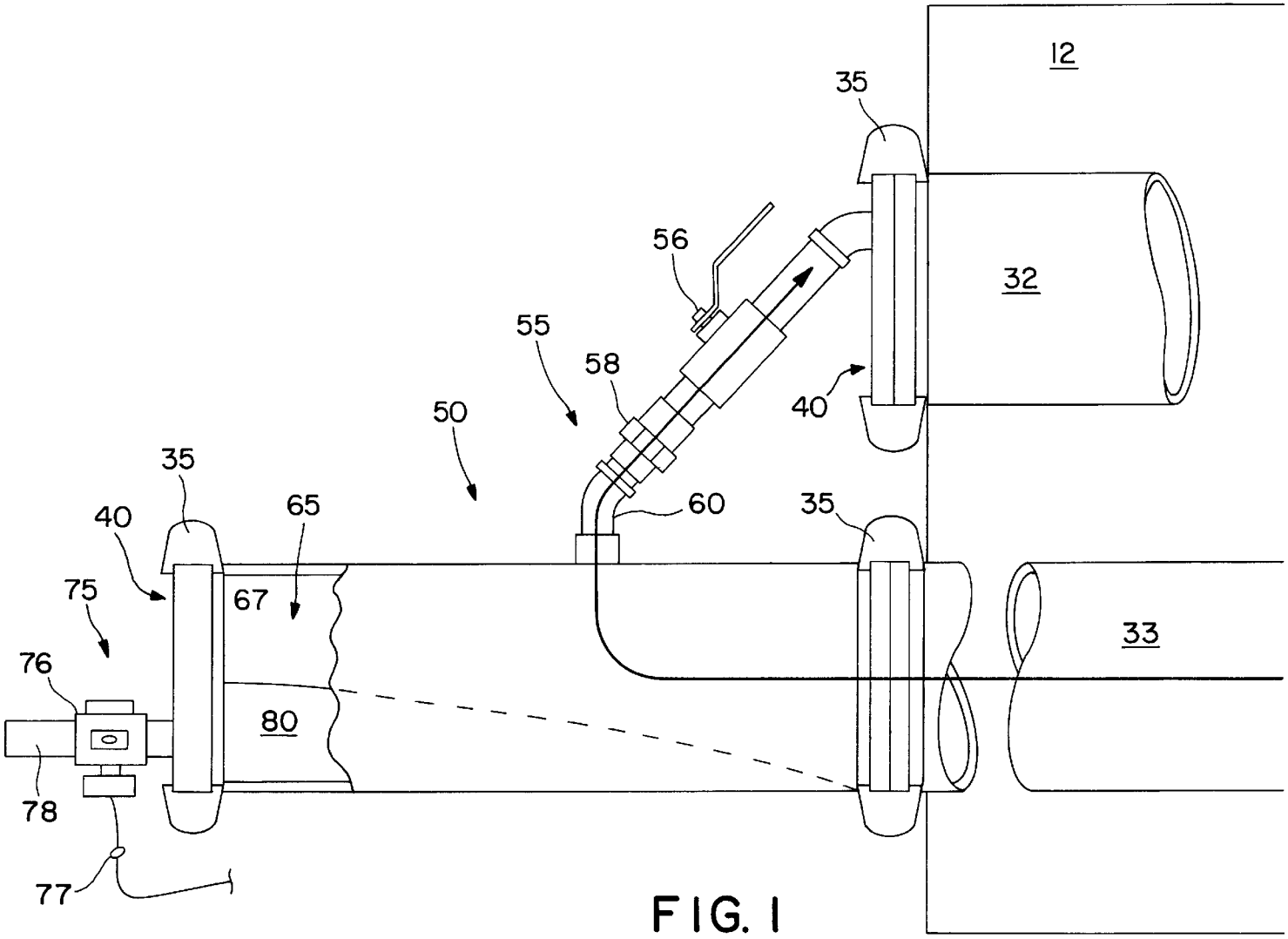

FIG. 1 is a partial cross-sectional view of the in-line trap of the present invention.

DESCRIPTION OF THE PREFERRED EMBODIMENT

With reference to FIG. 1, a refrigeration system used in an air conditioning installation is typically comprised of a series of individual modules 12 arranged in a side by side relationship. Each of the individual modules is connected together in series fashion by provision of releasable couplings designated at 35, which are known in the trade under the trademark VICTAULIC, to form fluid tight connections between header pipes on each individual unit. In FIG. 1, only a last module 12 is shown, although it should be understood that this module represents the end module in a series of serially attached individual modules with respect to the direction of the incoming cooling water supply, which is represented by the direction of the heavy arrow.

The header pipe 33 is used for conveying cold cooling water into the condenser coil (not shown) of the individual refrigeration module 12, while header pipe 32 is used for removing the cooling water once it has removed heat from the refrigerant flowing inside the condenser piping. As mentioned earlier, U.S. Pat. No. 4,852,362 is incorporated herein by reference and further discussion of the operation of the condenser and or other refrigeration components will not be discussed in further detail herein. For the sake of this discussion, the important discovery by the present invention concerns the relationship between the impurities held in suspension within the cooling water, and the serially-last individual refrigeration module 12 acting as a dead end for the flow of the cooling water. By that it is meant that the cooling water in the last individual cooling module behaves as a drip leg whereby water velocity is nearly reduced to zero before it enters the condenser, thereby allowing the impurities within the water to drop out of suspension. When this happens, the supply header 33, will typically clog with impurities over time, thereby causing the refrigeration unit to slowly lose operating efficiency. Eventually, it is possible for this last cooling water supply header to become completely blocked with debris usually in the form of a sludge-like mud. If that happens, that module will no longer remain a functioning part of the series of air conditioning modules since automated system controllers will sense the problem and cause that unit to be removed from operation. Likewise, the penultimate individual refrigeration module will slowly begin to experience the same phenomenon as the last cooling module such that if the problem is left uncorrected for a long enough period of time, each of the cooling water supply headers of the individual cooling modules will eventually become blocked with debris.

In order to overcome this problem, the present invention has discovered that an in-line trap assembly 50 can be provided to effectively eliminate the problem of header blockage as mentioned above. With the in-line trap assembly of the present invention, the momentum of the cooling water flowing through supply header 33 can be used as a means for pushing and assisting the debris from within the header 33 into the in-line trap so that all of the interconnected cooling water supply headers will continuously be maintained free from blockage.

As seen in FIG. 1, in-line trap assembly 50 is comprised of three major components, that being the bleed-through means 55, collector means 65, and blow-down means 75 which will now be explained in greater detail.

Bleed through means 55 is provided in order to create a continuous flow of cooling, water through supply header 33 and in turn, through cooling water return header 32. The bleed through means is comprised of an interconnection piping 60 having an upper and lower end extending between collector means 65 and header 32. It is envisioned that the piping is provided with a full ported ball valve 56 and at least one union 58 for quick disassembly. The ball valve is to be continuously left open during operation of the in-line trap assembly. The return header 32 is also provided with a releasable coupling 35 at its one header end wherein a cap or blank 40 is provided within the coupling 35 so as to seal the end of header 32 except for the interconnection with piping 60. At a lower end of bleed through means 55 the piping is typically connected to the collector means 65 through a pipe fitting coupling welded thereto.

The collector means 65 is comprised of a collection tank or in-line trap which is formed from a section of piping of essentially the same diameter as that of supply header 33 and having an open interior 67. In this way, the collector means 65 can easily be attached to supply header 33 through another releasable coupling 35 attached to the terminal end of supply header 33. The means 65 has a longitudinal extent which is preferably the same length of the header supply pipe 33 for each individual refrigeration module. In this way, any suspended debris which falls out of suspension, can be pushed by the momentum of the flowing cooling water, herein shown as the heavy arrow, as it flows from supply header 33, through bleed through means 55, into return header 32. Because the pressure inside of supply header 33 is always greater than that of return header 32, there is no difficulty in causing the cooling water to flow from supply header 33 to return header 32. Likewise, the energy within the flowing water is great enough to push debris into the collector means such that the end of the collector means will hold debris 80 therein. The distal end of collector means 65 is provided with a releasable coupling 35 and an end cap or blank 40 as shown, to seal the end of the collection tank. The blow-down means 75 is attached to end blank 40 and is in fluid communication with interior 67. The blow-down means 75 is comprised of a solenoid valve 76 which is provided with the appropriate electrical supply 77 and piping 78. The piping 78 is typically routed to a floor drain although it is not shown in FIG. 1. The solenoid valve 76 can be controlled in number of ways. For instance, the master programmable logic controller (not shown) which controls the series of individual refrigeration modules, can be interfaced with the solenoid valve for controlling the frequency of occurrences per hour, day, etc, which the valve is opened for blow-down of the debris 80, and for controlling the duration of the blow-down. The solenoid valve 76 could also be arranged to open upon some other trigger signal, such as a fluid pressure within header 33 or simply a repeatable, timed interval, say for instance, once every four hours, Since each individual application will vary in terms of amount and types of debris entrapped within the cooling water, adjustment of the frequency and duration of the blow-down is a matter of experimentation specific to the installation location. However, a proven indicator of proper frequency and duration is inspection of in-line basket strainers (not shown) as being free of any debris.

It should be understood that the present in-line trap assembly can be used on a refrigeration system containing a lone individual cooling module 12, and is not limited to use with only series installations.

The foregoing description has been provided to clearly define and completely describe the present invention. Various modifications may be made without departing from the scope and spirit of the invention which is defined in the following claims.

I claim:

1. In a refrigeration unit having a first fluid supply header pipe and a second fluid return header pipe, an assembly for collecting and removing debris from a water supply used in connection with a refrigeration unit, said water flowing from said first fluid supply header to said second fluid supply header, said assembly comprising:

collector means having an interior for receiving and retaining debris discharged from said flowing water supply, said collector means having a closed terminal end and a connection end, said closed terminal end fluidly sealed, said connection end adapted for securement to one of said first and second headers of said flowing water supply;

bleed-through means attached to said collector means and disposed between said ends of said collector means, said bleed-through means adapted to continuously allow water flow from said first header to said second header;

blow-down means attached at said terminal end of said collector means and in communication with said interior of said collector means, said blow-down means for intermittently disposing of debris retained within said collector means.

2. The assembly of claim 1 wherein said collection means is comprised of a collection tank, said tank formed of a piping identical to said piping headers.

3. The assembly of claim 1 wherein said blow-down means is comprised of a piping and valve arrangement.

4. The assembly of claim 3 wherein said valve of said blow-down means is a manually operated ball valve.

5. The assembly of claim 3 wherein said valve of said blow-down means is a solenoid valve controlled by a programmable logic controller.

6. The assembly of claim 1 wherein said bleed-through means includes a valve for preventing the flow of water between said headers.

7. The assembly of claim 6 wherein said valve of said bleed-through means is connected to a piping connection which includes a union.

8. An improved expandable refrigeration system for transferring heat from one fluid to another where a total load requirement is supplied by a plurality of modular units, comprising:

an assembly of a plurality of readily interconnectable and transportable, substantially identical complete modular refrigeration units each of which includes:

a housing means to carry at least one refrigeration circuit including an electrically powered compressor means, evaporator means and condenser means, each said housing further containing a first fluid flow passage means for flow of a first fluid in heat exchange relation with said evaporator means, and a separate second fluid flow passage means for flow of a second fluid in heat exchange relation with said condenser means, a first fluid supply means in fluid communication with the first fluid flow passage means to supply said first heat exchange fluid thereto, a first fluid return means in fluid communication with said first fluid flow passage means to remove said heat exchange fluid therefrom, second fluid supply means in fluid communication with said second fluid flow passage means to supply said second heat exchange fluid thereto, said first fluid supply means and said first fluid return means comprising header pipes extending laterally of said housing means, and releasable connectors interconnecting adjacent ends of said header pipes of adjacent modular units to form a unitary fluid supply manifold and a unitary fluid return manifold for the assembly to interconnect the first flow passage of respective units in parallel, and to readily enable replacement or addition or removal of a unit from the system, and an assembly for collecting and removing suspended debris from said first fluid, said assembly comprising a collector having an interior to collect and retain debris discharged from said fluid, a bleed-through means for moving said debris to a terminal end of said collector, and a blow-down means in communication with said interior of said collector for removing said debris, wherein said collector is connected to a terminal end of said first fluid supply means and said bleed-through means communicates fluid between said collector and said first fluid return means.

9. The refrigeration system of claim 8, wherein a momentum energy within said first fluid physically imparts motion to said debris so as to move it from said first fluid supply means to said terminal end of said collector.

* * * * *